US005759058A

United States Patent [19]

Childs et al.

[11] Patent Number: 5,759,058

[45] Date of Patent: Jun. 2, 1998

[54] CONNECTOR POSITION ASSURANCE COMPONENT

[75] Inventors: Jonathan Childs, Rochester; Jeffery A. Price, Oxford, both of Mich.

[73] Assignee: Cardell Corporation, Auburn Hills, Mich.

[21] Appl. No.: 876,233

[22] Filed: Jun. 16, 1997

Related U.S. Application Data

[63] Continuation of Ser. No. 470,013, Jun. 6, 1995, abandoned.

[51] Int. Cl.[6] ..... H01R 13/627

[52] U.S. Cl. ..... 439/352

[58] Field of Search ..... 439/350, 352–355, 439/357, 358, 345, 488, 489

[56] References Cited

U.S. PATENT DOCUMENTS

| | | | |
|---|---|---|---|
| 4,370,013 | 1/1983 | Niitsu et al. | 439/352 |
| 4,708,413 | 11/1987 | Schroeder | 439/358 |
| 4,711,511 | 12/1987 | Noorily | 439/347 |
| 4,801,275 | 1/1989 | Ikeda et al. | 439/350 |
| 4,946,395 | 8/1990 | Cope et al. | 439/352 |
| 4,963,103 | 10/1990 | Fink et al. | 439/352 |
| 4,979,910 | 12/1990 | Revil et al. | 439/357 |
| 5,120,240 | 6/1992 | Reider | 439/352 |
| 5,120,255 | 6/1992 | Kouda et al. | 439/489 |
| 5,174,786 | 12/1992 | Kato et al. | 439/489 |
| 5,219,300 | 6/1993 | Yagi et al. | 439/532 |
| 5,226,834 | 7/1993 | Kato et al. | 439/489 |
| 5,234,356 | 8/1993 | Maejima et al. | 439/352 |
| 5,292,258 | 3/1994 | Sakurai | 439/353 |
| 5,330,366 | 7/1994 | Tsuji et al. | 439/352 |
| 5,348,493 | 9/1994 | Power | 439/352 |

*Primary Examiner*—Hien Vu

*Attorney, Agent, or Firm*—Jones, Tullar & Cooper

[57] ABSTRACT

A connector position assurance (CPA) device for use with the latching mechanism of a two-part connector includes a transverse body portion, two spaced, parallel, flexible side arms, and a flexible, generally Z-shaped bottom arm. The bottom arm has a pivot point which causes the distal end of the arm to pivot upon assembly of the connector and consequent flattening of the bottom arm. The rotation of the distal end releases the CPA from a rest position upon complete latching of the components to permit the CPA to move to an engaged position which locks the latch mechanism.

4 Claims, 7 Drawing Sheets

CONNECTOR POSITION ASSURANCE COMPONENT

This application is a continuation, of application Ser. No. 08/470,013, filed Jun. 6, 1995, now abandoned.

BACKGROUND OF THE INVENTION

The present invention relates, in general, to an electrical connector which comprises a two-part housing including a plug component and a socket component and, more particularly, to a positive locking device, which provides visual and mechanical assurance of the relative positions of the components and thereby verifies the complete mating of the two components.

Many two-part electrical connectors, particularly those designed for use under adverse conditions, incorporate a latching mechanism such as that described in prior patents such as U.S. Pat. No. 5,295,875 of Willard B. McCardell, Jr., which is assigned to the assignee of the present application, which releasably holds the plug component and socket component in their desired assembled condition. Often, however, it is difficult to determine whether the components are fully mated, and the present invention is directed to an independent connector position assurance which is manually attachable to the aforementioned latching mechanism of the electrical connector for detecting connector components which are only partially mated, and, in addition, for preventing the two mated connector components from separating.

The prior art has described a wide variety of connector position assurance devices. For example, U.S. Pat. No. 5,120,255 of Tomoyuki Kouda, et al, discloses a connector position assurance component for utilization with a connector in which either the plug component or the socket component incorporates a tabbed latch. This latch pushes down on a connector position assurance component during mating of the first connector component to the second connector component, thereby freeing the connector position assurance component and allowing it to be manually slid into its final position. The prior art also discloses a connector having a lock release prevention device which includes a flexible arm having a projection which causes the arm to bend as the connector halves are assembled. This moves the end of the flexible arm to prevent a sliding portion from locking into final position if the connector halves are not properly assembled. Other prior patents show electrical connectors having a locking arm that is pivotally connected, or having a locking arm with a resilient bar, with a connector position assurance device which slides or locks into place after the two connector halves are properly mated. Although such prior devices have been generally effective for particular connector structures, they have not been suitable for use with electrical connectors which incorporate a releasable latching mechanism, such as that disclosed in the aforementioned U.S. Pat. No. 5,295,875.

BRIEF SUMMARY OF THE INVENTION

It is therefore an object of the present invention to provide a connector position assurance mechanism for a two-component connector, which provides visual and mechanical assurance of the relative positions of the components to thereby verify the complete mating of the two connector components.

It is a further object of the invention to provide a connector position assurance mechanism for a connector having a plug component and a socket component, and which indicates that the two connector components are mated only when the plug component and socket component are fully and completely mated, thereby ensuring continuous and reliable electrical contact by permitting visual detection of partially or improperly mated connectors.

Another object of the invention is to provide a connector position assurance mechanism which incorporates a positive latching capability, thereby preventing a mated connector from becoming inadvertently demated.

Another object of the invention is to provide a connector position assurance and positive latching device which is manually releasable, thereby allowing the connector components to be intentionally demated when desired.

Briefly, the present invention is directed to an improved connector position assurance (CPA) device for use with the latching mechanism of a two-component connector device. The CPA is independent of the connector, and is mechanically mounted on one of the two connector latch components in an initial or "ready" position, so as to be in place for activation by manually sliding, when the two connector components are joined. The CPA includes a flexible arm which reacts with the connector latch components as they move toward a fully mated connection, thereby causing a pivoting motion of the CPA arm, and further allowing the CPA device to slide into its final locked position only when the electrical connector is fully and properly mated. Additionally, after the connector position assurance device is seated in its final position, the two connector components cannot be demated from each other unless the connector position assurance device is manually slid back to the initial or "ready" position. It will be understood that although the present invention is illustrated in conjunction with the latching mechanism of a particular two-part connector for electrical wiring harnesses, it may equally well be used with other latchable connectors, and is not limited to use with electrical connectors.

The CPA of the present invention comprises a molded plastic connector position assurance member having a transverse body portion, two forwardly-extending side arms, one at each end of the body portion, and a forwardly-extending flexible lower arm extending from the lower edge of the transverse body portion. The lower arm has a first segment which normally extends forwardly and downwardly at about a 20° angle from the lower edge of the body portion to a lowermost first bend, or elbow, has a second segment which extends forwardly and upwardly from the elbow to a second bend, and has a third segment which extends forwardly from the second bend to its distal end. The third segment lies in a plane which also includes the lower edge of the body portion, so that the lower arm generally forms a "Z" shape in side view before it is inserted into a connector latch.

The second bend of the "Z" of the lower arm includes a pivot point on its top surface which bears upon a portion of the connector latching mechanism when the CPA is in use. The second lower arm segment, between the first and second bends, acts as a lever arm for the third lower arm segment to rotate the lower arm about the pivot point to force the distal end of the flexible lower arm in a downward direction as the two connector components are latched together. If a first connector component, which carries the CPA in its ready position and a second connector component are fully mated together, the pivoting action forces the distal end of the lower CPA arm down so that it is below a latching shoulder on the first connector component. Once the distal end of the arm is below the latching shoulder, the connector position assurance member is free to slide into its final, or latched position. The side arms on the CPA each have an inwardly extending tooth which snaps into place at an adjacent groove in the connector latching mechanism when it reaches its final position to secure the CPA and indicate full mating of the connector. If the connector halves are not completely mated, the distal end of the lower arm will not be pivoted below the latching shoulder on the first connector half, thereby preventing the connector position assurance device from sliding to its final position.

BRIEF DESCRIPTION OF THE DRAWINGS

The foregoing, and additional objects, features and advantages of the present invention will become apparent to those of skill in the art from the following detailed description of preferred embodiments thereof, taken in conjunction with the accompanying drawings, in which:

FIG. 6A is an enlarged view of a portion of FIG. 6;

DESCRIPTION OF PREFERRED EMBODIMENT

Figure 1:
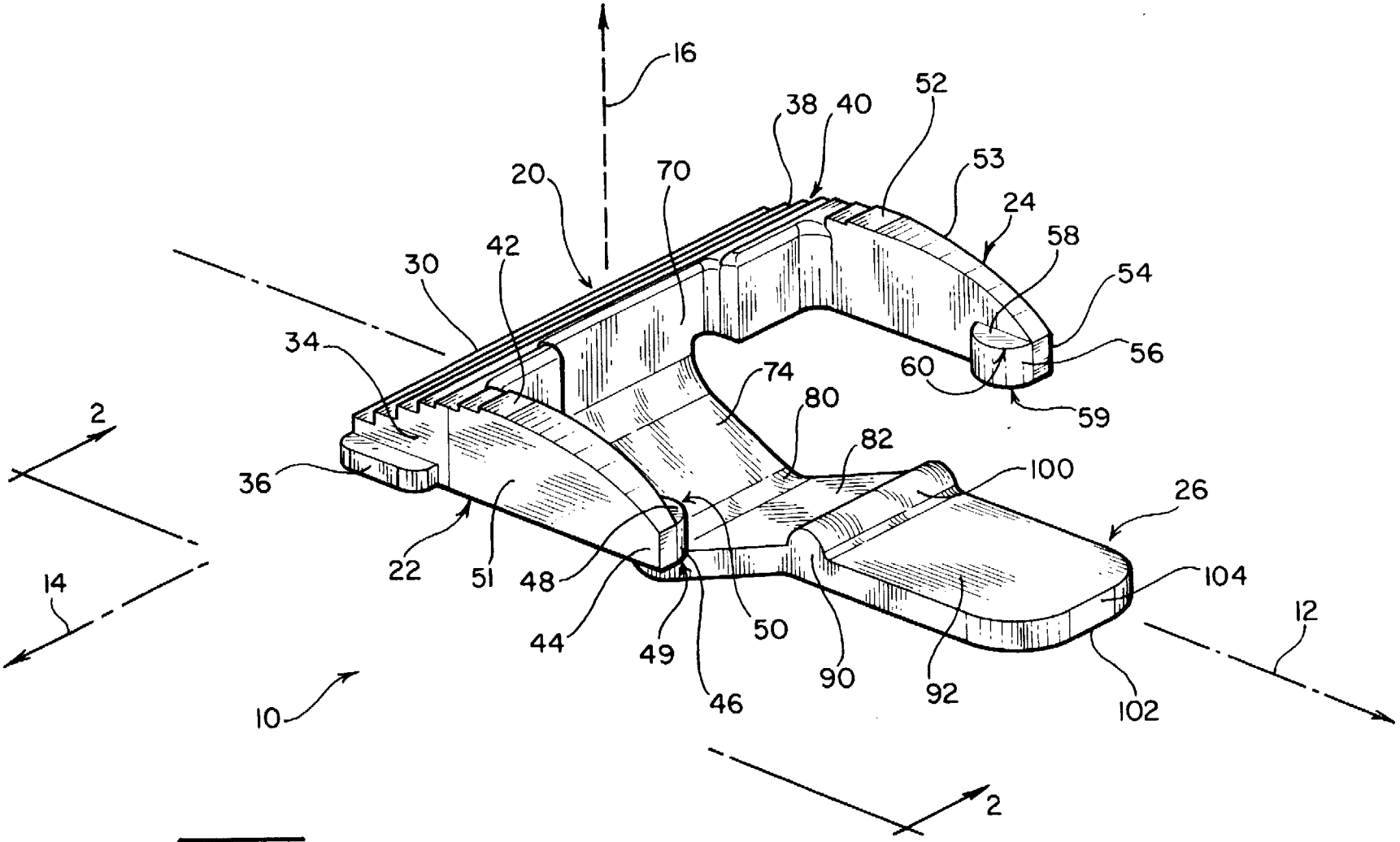
FIG. 1 shows an isometric view of a preferred form of a connector position assurance component in accordance with the present invention.
Figure 2:
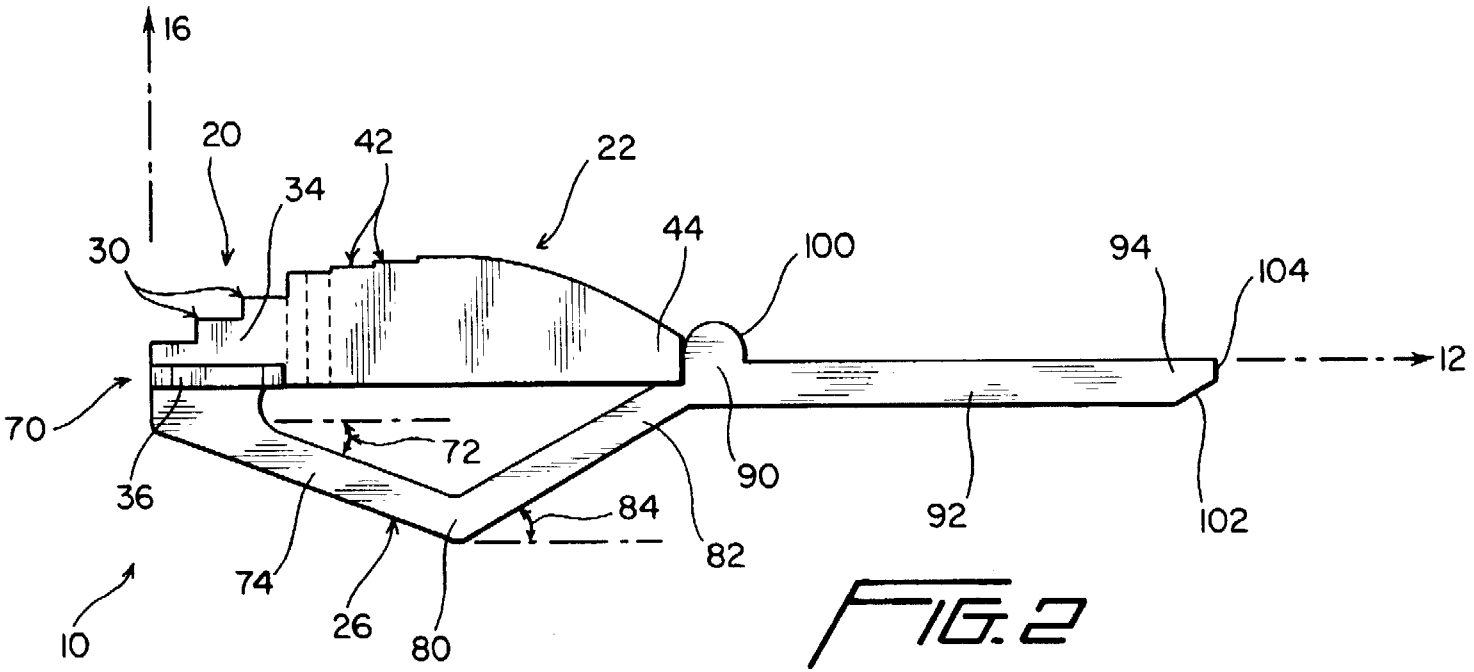
FIG. 2 is a side view of the connector position assurance component of FIG. 1, viewed along arrows 2—2 thereof.
Figure 8A:
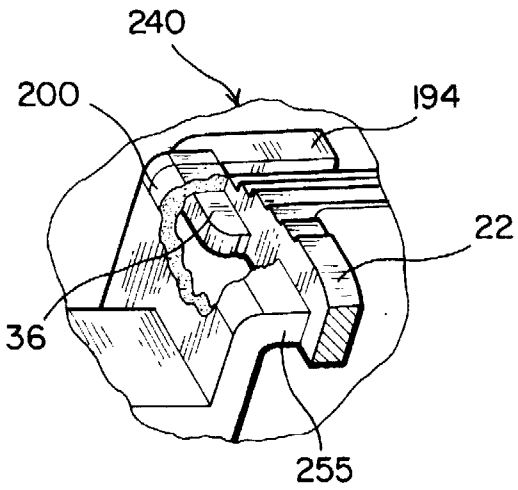
FIG. 8 is the connector of FIG. 7 with the connector position assurance component fully engaged.

Turning now to a more detailed description of the present invention, there is illustrated in FIGS. 1 and 2 a connector position assurance (CPA) component 10 for use with a two-component connector in accordance with the present invention. The connector position assurance component 10 is preferably of molded plastic construction utilizing conventional and well-known materials and molding processes. A set of CPA reference coordinate axes are shown in FIG. 1, with a longitudinal axis 12 generally corresponding to the installation direction and thereby to the longitudinal direction of an electrical connector which receives the CPA, a transverse axis 14 representing the width of the CPA, and a vertical axis 16 corresponding to the height of the CPA. The CPA 10 is generally comprised of a back or body portion 20, first and second forwardly extending side arms 22 and 24, and a forwardly extending lower arm 26.

The body portion 20 generally extends along the axis 14 of the CPA 10, having a width dimension greater than the length and height dimensions along axes 12 and 16. In the preferred form, the body 20 is generally triangular in cross section, with ridges or "steps" 30 forming the rearward and top surface of the body, to provide a gripping surface on the CPA to facilitate installation. A first end wall 34 of the body portion 20 includes an outwardly extending tab 36, which protrudes out from the wall 34 in the direction of axis 14, and which is generally equal in dimension to the body in the direction of axis 12, but is less in dimension than the body in the direction of axis 16. Similarly, the second end wall 38 of the body 20 includes an outwardly extending tab 40, which is hidden from view in FIG. 1. These outwardly extending tabs engage corresponding grooves in a connector latch, as will be described, to guide the CPA when it is inserted.

The first forwardly extending side arm 22 originates at the first end of the body portion 20, and protrudes forwardly in a direction parallel to the axis 12. The side arm 22 is thin, flexible, and is generally equal in its height dimension along axis 16 to that of the body portion 20 where it joins the body, and tapers generally inwardly toward its free, or forward end. The length of the arm 22 in the direction of axis 12 is equal to approximately three-quarters of the width of body 20, along axis 14. The ridges or steps 30 on the body 20 extend partially along the upper surface 42 of the side arm 22. At the forward, or free end 44 of the arm 22 is a locking tab 46 which extends inwardly, parallel to axis 14, toward the center of the CPA 10. The tab 46 is semicylindrical, being flat at its top and bottom surfaces, as illustrated at 48 and hidden at 49, respectively, but having a rounded inner surface 50. The outer surface 51 of arm 22 is flush with end wall 34 of the body portion.

The second forwardly-extending side arm 24 is a mirror image of arm 22, and originates at the second end 38 of the body portion 20. Similarly to side arm 22, arm 24 protrudes forwardly and is parallel to the axis 12. The thin, flexible side arm 24 is also equal in height dimension along axis 16 to the body portion 20, and in length, along axis 12, is equal to approximately three-quarters of the body width, along axis 14. The ridges or steps 30 on the body 20 also extend partially along the upper surface 52 of the side arm 24 and the outer surface 53 is flush with end wall 38 of the body portion. At the forward, or free end 54 of the arm 24 is a semicylindrical tab 56 which extends inwardly, parallel to axis 14, towards the center of the CPA. The tab 56 has flat top and bottom surfaces, shown at 58 and hidden at 59, respectively, and has a rounded inner surface 60.

The proportions of the side arms, that is, the relative width in the direction of axis 14 of the arms 22 and 24 with respect to their height in the direction axis 16, provide lateral, or inward and outward, flexibility with respect to axis 12, and vertical stiffness for the arms. The arms are spring-like, and tend to return to their original position when flexed.

The forwardly extending, "Z" shaped, lower arm 26 extends downwardly from the lower portion 70 of the body 20. As best illustrated in FIG. 2, arm 26 extends at a downward angle of approximately 20° away from a line parallel to axis 12, as illustrated at 72. A first segment 74 of lower arm 26 continues downwardly and forwardly at this angle to a first bend, or elbow, in the "Z", indicated at 80, at which location a second segment 82 of the arm continues forwardly, but at an upward angle 84 of approximately 30° from a line parallel to axis 12, shown at 84. The second segment 82 of arm 26 extends upwardly and forwardly to a second bend in the "Z", indicated at 90, at which location it joins a third segment 92 of the arm which extends horizontally forwardly along axis 12 to a distal, or free end 94. The second bend 90 functions as a pivot point about which segments 82 and 92 of the arm rotate in order to free the CPA and allow it to be slid into its final position, as will be described in more detail in the following paragraphs. At the location of bend 90 is a curved upward protrusion 100 on the top surface of arm 26, which extends fully along the width of the arm, in the direction of axis 14, as illustrated in FIG. 1. In cross section the protrusion 100 is generally semi-circular, as best seen in FIG. 2. At the forward end of the arm 26 is an upwardly tapered lower edge 102 which conforms to the mating connector half when placed in its final position, as will be described, and the arm 26 terminates at a forward edge 104. The arm 26 is flexible but spring-like so that it can be flattened during mating of a connector, but will spring back to its original shape when released.

Figure 3:
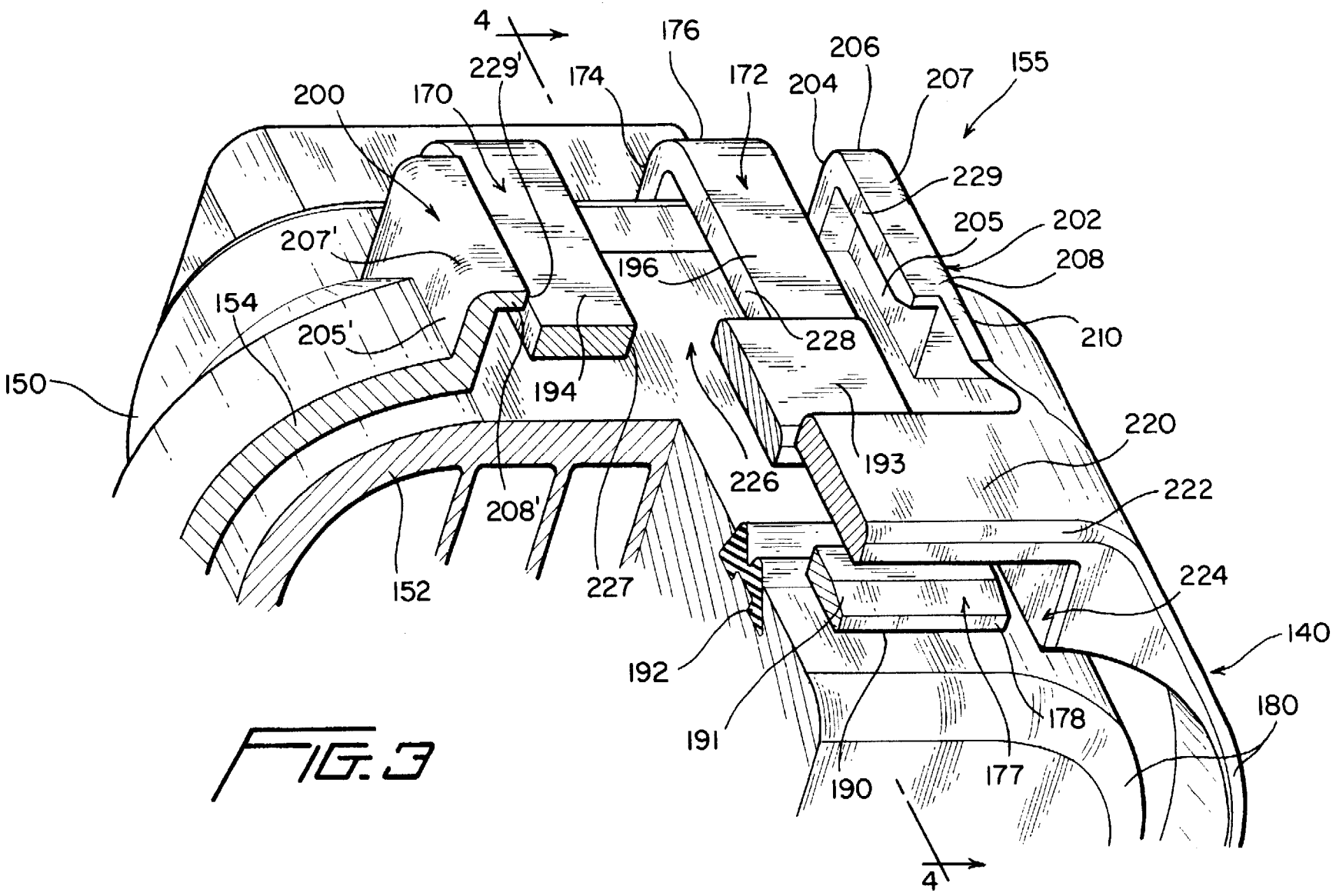
FIG. 3 is a partially cut-away isometric view of a connector component including a mechanical latching mechanism.
Figure 4:
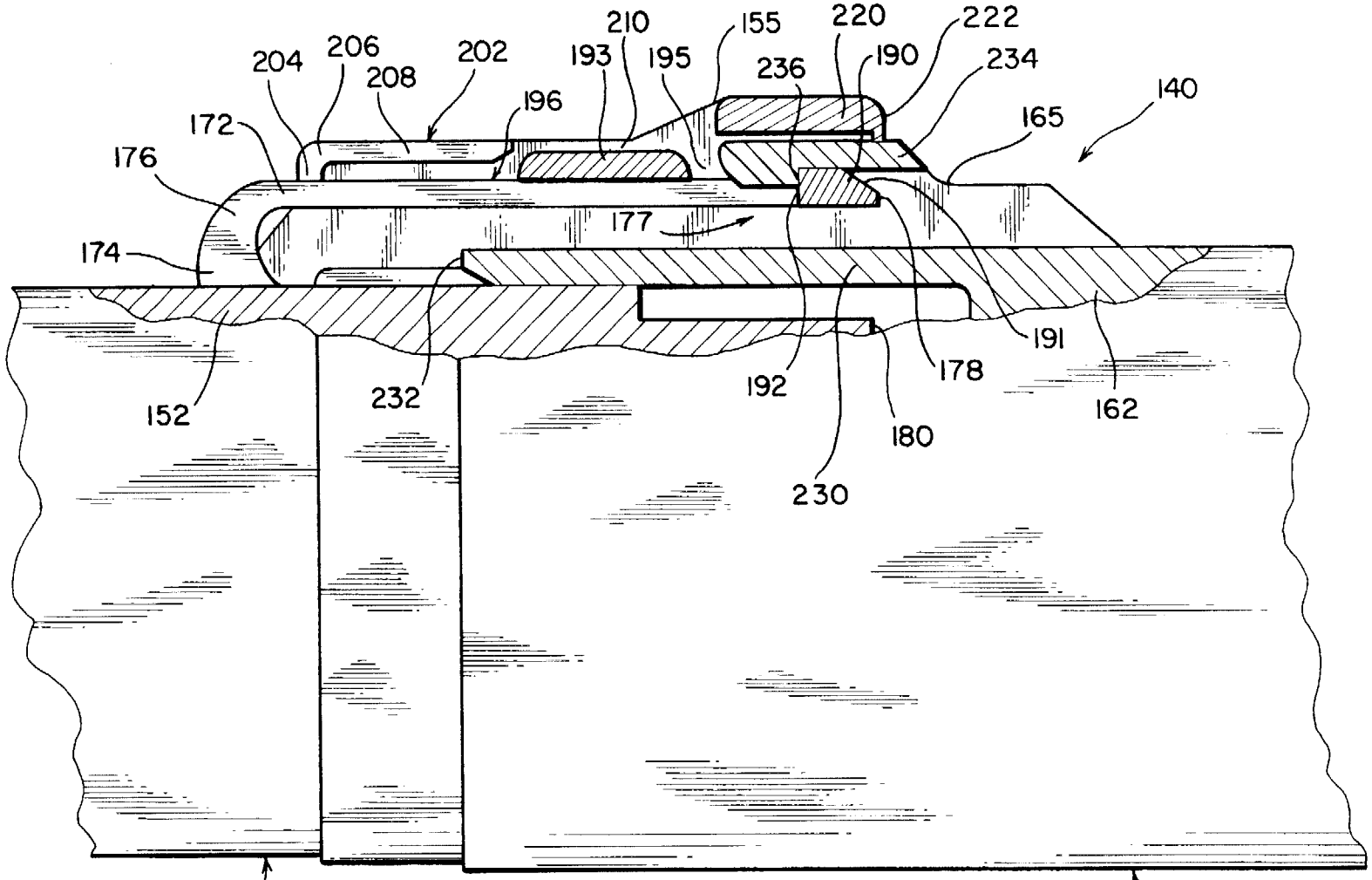
FIG. 4 is a partially cut-away cross-sectional view of a connector with two connector halves fully mated and a latching mechanism engaged, viewed along arrows 4—4 of FIG. 3.

The function of the CPA of the present invention is best described in conjunction with its use in a connector latch mechanism 140, such as that illustrated in FIG. 3. This Figure illustrates which is a partially cut-away isometric view of a first electrical connector component 150, having a body portion 152 with a surrounding shell 154 having a corresponding first mechanical latching mechanism generally indicated at 155. FIG. 4 shows a partially cut-away cross-sectional view of the connector component 150 fully mated to a second, corresponding connector component 160 having a body portion 162 and a corresponding second mechanical latching mechanism 165, which is shown fully engaged with the first latching mechanism 155. The cross-sectional view of FIG. 4 is taken along lines 4—4 of FIG. 3. The construction of the connector components 150 and 160 and the two parts 155, 165 of the latching mechanism 40 and will not be fully described in the present application, as these elements are shown and described in the aforementioned U.S. Pat. No. 5,295,875, the disclosure of which is hereby incorporated herein by reference. However, certain attributes which are pertinent to the use of the present invention will be described herein.

The latching mechanism component 155 of the first connector component 150 includes two elongated flexible latch arms 170 and 172, which extend upwardly from the connector body 152 as at 174, then bend 90°, as at 176, and continue longitudinally forward (to the right as viewed in FIGS. 4 and 5) parallel to the axis of the connector body, until terminating at a forward end 177 having a forward edge 178 which is approximately coplanar with a forward edge 180 of the connector body 150. At end 177 of arm 172 a laterally-extending cross-segment 190 is provided, as illustrated in partial perspective in FIG. 3 and in cross-section in FIG. 4, which extends to a corresponding end of latch arm 170, and connects with arm 170 to form a forward latching bar. Bar 190 has a sloped upper surface 191 which engages the leading edge of the latching mechanism 165, and has a rearward latching shoulder 192.

A second lateral segment 193 (FIG. 3) extends between and joins latch arms 170 and 172, approximately two-thirds along the length thereof and rearwardly of cross bar 190. Segment 193 extends from the upper surfaces 194 and 196, respectively, of latch arms 170 and 172; that is, lateral segment 193 is at a higher elevation above the connector body 150 than is bar 190, as viewed in FIG. 4, and forms a locking bar to hold the CPA in place in both its ready position and its locked position.

The latching mechanism component 155 additionally includes two spaced outer wall elements 200 and 202, each of which protrudes upwardly from the connector body shell 154. Wall element 202, for example, includes a rear wall portion 204 and a side wall portion 205 which extend upwardly and curve forwardly at 206 and inwardly at 207 (FIG. 3) to form a top portion 208. The side wall portion extends forwardly, as at 210, to a lateral latch cover segment 220 which has a sloped forward edge 222, approximately coplanar with the forward edge 180 of connector body 150. As shown in FIG. 3 and in cross-section in FIG. 4, the latch cover segment 220 spans a latch entry aperture 224 between wall elements 200 and 202. Wall element 200 is a mirror image of wall 202, and is similarly numbered with the numbers being primed.

Inner walls 227 and 228 of the spaced flexible latch arms 170 and 172 define a central longitudinal slot 226 (FIG. 3) below locking bar 193 for receiving the lower arm 26 of the CPA 10, as will be more fully explained. The side walls 200 and 202 include inner faces 229 and 229' which are spaced outwardly from the arms 172 and 170, respectively, to provide longitudinal guide surfaces for the outer surfaces 53 and 51 of arms 22 and 24, respectively, of the CPA. The upper surfaces 194 and 196 of arms 170 and 172 support respective ends of the body portion 20 of the CPA and support the bottom surfaces of arms 22 and 24 for sliding motion forwardly, i.e., to the right, and rearwardly; i.e., to the left, as viewed in FIG. 2.

Referring to FIG. 4, the second connector component 160 comprises a forward-reaching (to the left as viewed in the Figure) shell 230, which terminates at a leading edge 232 and which fits over body portion 152 and inside shell 154 of the first connector component when the two connector components are assembled. The latching mechanism component 165 includes a latch arm 234, including a shoulder 236, which under cover segment 220 and extends through aperture 224 and interlocks with shoulder 192 on member 190 of mating connector component 150, as illustrated, to provide the latching feature of the electrical connector.

Figure 5:
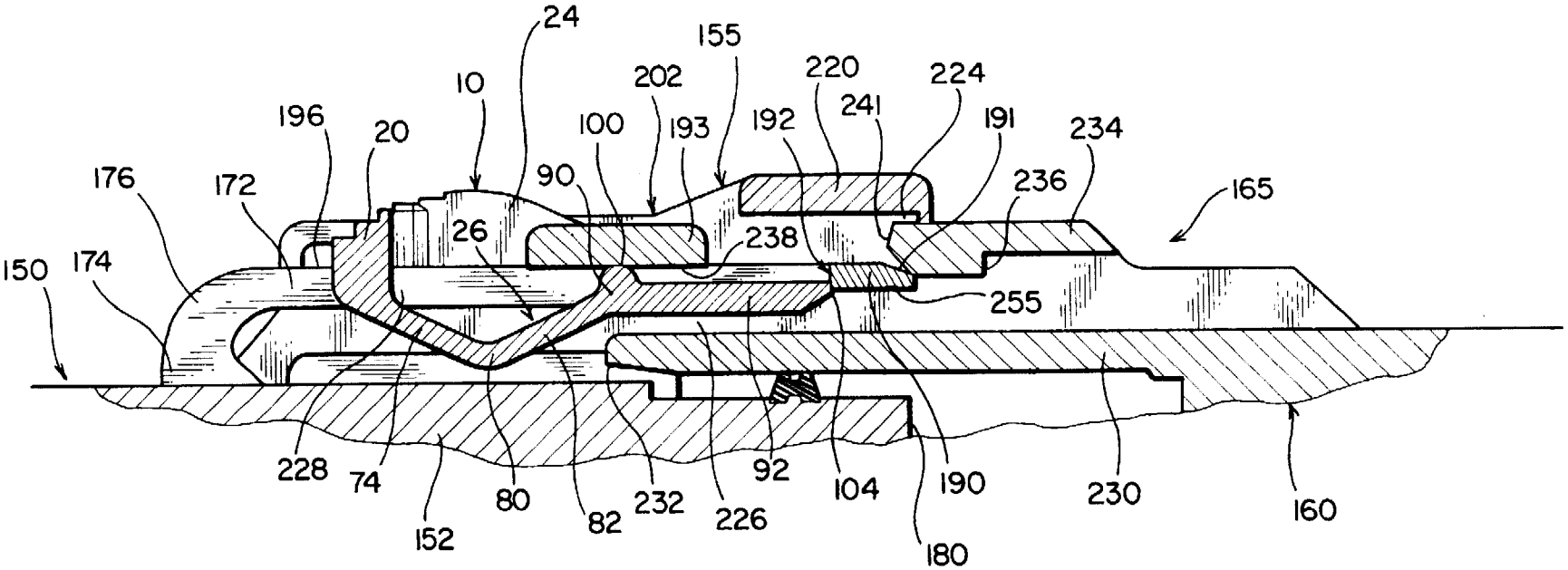
FIG. 5 shows the cross-sectioned area of FIG. 4 with the two connector halves only partially mated and the latching mechanism not yet engaged, and with the connector position assurance component of the present invention installed in its initial position.

Turning now to FIG. 5, the latching mechanism 140 is shown in a pre-mated position, wherein the connector halves 150 and 160 are initially joined but not seated, with the two latch components 155 and 165 in initial contact with each other. Additionally shown is the CPA 10 in a preliminary installation location; i.e., in the "ready" position in which it is mounted on the first connector component 150. The CPA is held in this "ready" position prior to the complete mating of the connector halves 150 and 160, and prior to the sliding of the CPA into its final position. The CPA is positioned between walls 200 and 202, with the CPA arm 26 in slot 226 beneath locking bar 193, with arms 22 and 24 resting on the top surfaces 194 and 196 of arms 170 and 172, and the forward ends 44 and 54 of CPA arms 22 and 24 flexed slightly outwardly and engaging opposite ends of the bar 193.

The upward protrusion 100 of the CPA engages the lower surface 238 of locking bar 193 to hold the CPA in place during mating of the connector, with the elbow 80 extending downwardly in the slot 226 between arms 170 and 172 and thus into the path of the second connector component 160. The distal end 92 of arm 26 extends forwardly, parallel to and between arms 170 and 172 with the forward edge 104 of the CPA 10 in contact with the inner shoulder 192 of the lateral latching bar 190, as illustrated in cross-section in FIG. 5. In this position, the CPA cannot be moved further forward, thereby providing a visual and tactile indicator that the connector components are not fully mated. The latch arm 234 of the latch mechanism 165 engages the top surface of latching bar 190 to prevent the bar from deflecting upwardly so that the edge 104 of the CPA maintains contact with shoulder 192. This prevents the CPA from being slid longitudinally forward (to the right in FIG. 5) along the axis 12

(FIG. 1) while the two connector halves 150 and 160 are in the illustrated condition of initial contact.

Figure 6:
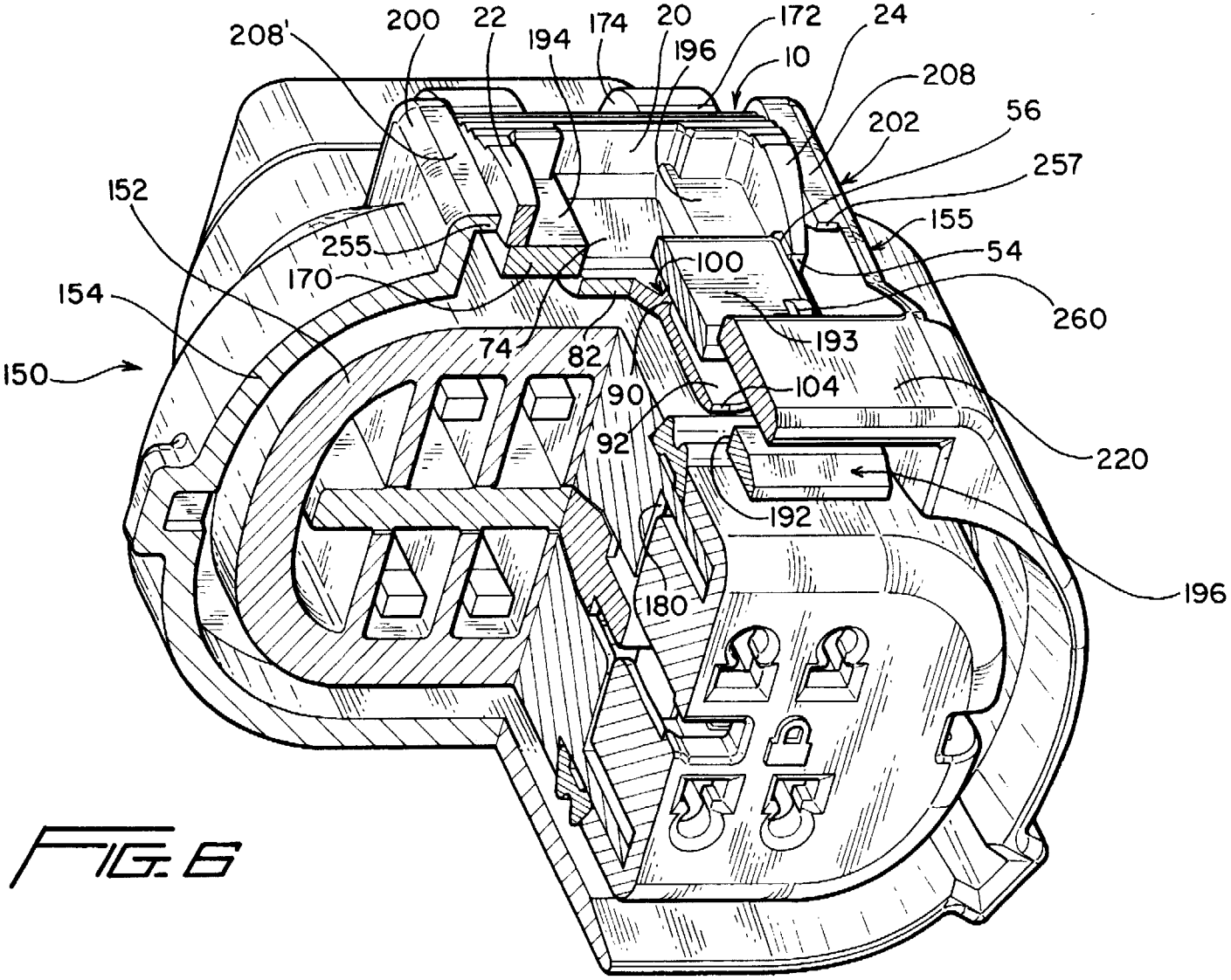
FIG. 6 is a partially cut-away isometric view of one component of an electrical connector, additionally showing the initial position of the connector position assurance component, installed generally as in FIG. 5.

Referring now to FIG. 6, the connector half 150 is shown with the CPA 10 mounted in its ready position, prior to the connector halves reaching the position shown in FIG. 5, and thus prior to the edge 104 contacting shoulder 192. As previously described, top surfaces 194 and 196 of arms 170 and 172 of the latching mechanism 155 function as supports for arms 22 and 24 of the CPA 10 to thereby support the CPA. The tabs 36 and 40 protruding from the CPA body 20 slide under the top walls 208, 208' of elements 202, 200, respectively, thereby securing the CPA in place on the connector latch mechanism 155. The walls 208, 208' prevent the CPA from moving upwardly out of the latching mechanism 155, as in the direction of axis 16 of FIG. 1, while allowing longitudinal sliding motion. This is illustrated in greater detail in FIG. 6A at 250. The tabs prevent the CPA from being pushed out of slot 226 when the connector halves are mated.

Figure 7:
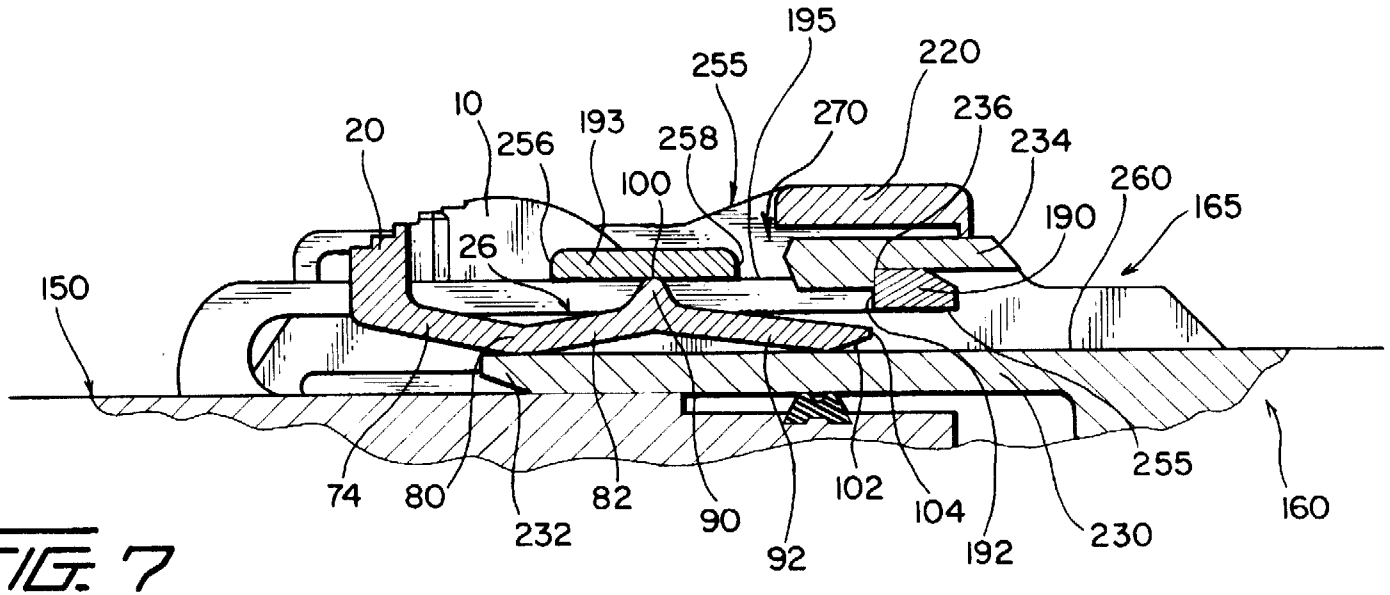
FIG. 7 is the connector of FIG. 5 with the two connector halves fully mated and the latching mechanism engaged, as in FIG. 4, with the connector position assurance device in its initial installation position.

As the right-hand connector component 160 moves toward the left with respect to component 150, as viewed in FIG. 5, for example, and is mated with component 150, latch arm 234 presses down on latching bar 190 and flexes latch arms 170 and 172 downwardly, allowing the leading edge 241 of arm 234 to pass over bar 190. At the same time, leading edge 232 of shell 230 moves toward the left and engages the portion 82 of CPA arm 26, forcing elbow 80 upwardly to flatten arm 26. This continues until the shoulder 236 on latch arm 234 passes over bar 190 and the bar springs back up to allow shoulder 192 to engage shoulder 236, at which time the connector components are fully engaged, as illustrated in FIG. 7.

After the two connector halves are fully engaged, or mated, the installation of the CPA can be completed. With the latching mechanism components 155 and 165 fully engaged, and shoulder 236 of latch arm 234 engaging latching shoulder 192, the leading edge 232 of shell 230 of the connector component carrying latch 165 will fully engage the CPA at elbow 80. This causes a clockwise pivoting action of portion 82 of the arm 26 about bend 90, which is restrained at protrusion 100 from upward motion by locking bar 193. It also causes a clockwise pivoting action of CPA member 92 about bend 90, causing end 104 to move downwardly so that when bar 190 returns upwardly to its latched position, the downwardly pivoted forward end 104 drops below the bottom surface 255 of bar 190, as illustrated in FIG. 7. The end 104 is restrained by the surface 260 of shell 230, so that the flexible "Z" shaped lower arm 26 of the CPA 10 is forced to flatten out. This releases the CPA so that it is free to slide smoothly forwardly, with arm 26 sliding along the outer surface 260 of the shell 230 of connector component 160 toward its engaged position illustrated in FIG. 8.

Figure 8:
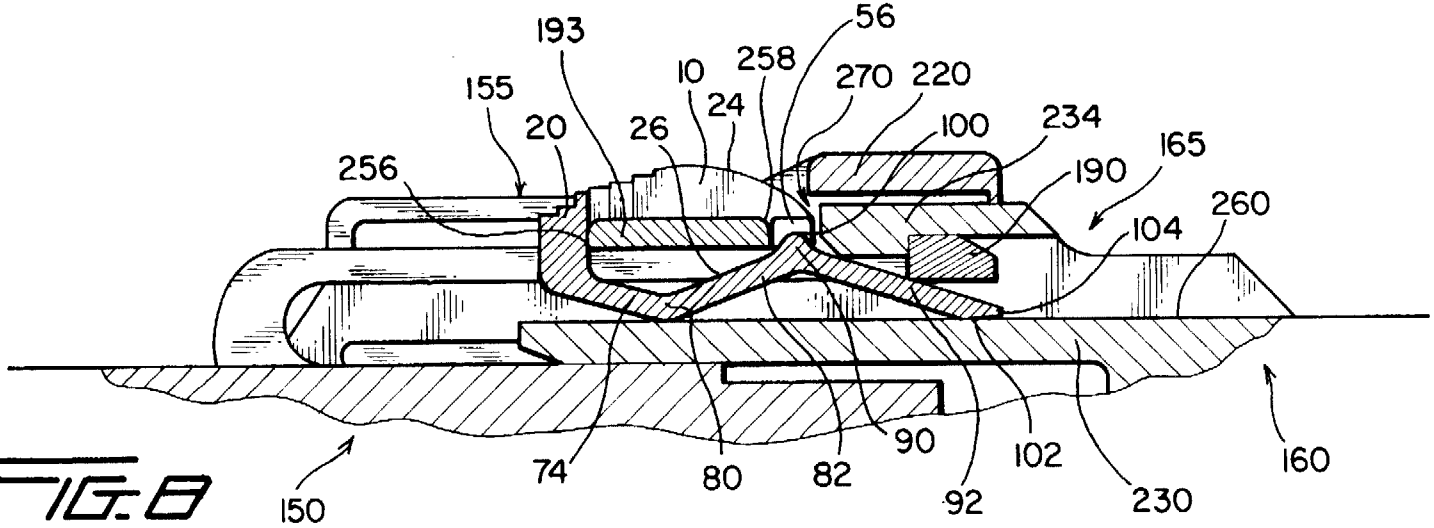

When the CPA 10 moves forwardly and slides fully into place, the body portion 20 contacts the rearward edge 256 of locking bar 193, the spring action of arms 22 and 24 causes the tabs 46 and 56, to snap inwardly around the front edge 258 of lateral member 193, and the spring action of arm 26 causes the arm to return to its normal "Z" shape as the protrusion 100 passes the front edge 258. This causes protrusion 100 to snap upwardly into the gap 270 between locking bar 193 and latch arm 234 and to thereby lock around the bar 193. FIG. 8 illustrates tab 56, which protrudes from CPA arm 24, as being locked around bar 193; a similar arrangement exists on the opposite side of the CPA, where tab 46 on CPA arm 22 also locks around the front edge of bar 193. Alternatively, the tabs 46 and 56 may snap into grooves 260 (see FIG. 6) at the ends of member 193.

As illustrated in FIG. 8, when the CPA 10 is moved into its engaged position, the forward segment 92 of arm 26 moves into a position beneath the latching bar 190, and between bar 190 and connector shell 230, thereby preventing bar 190 from moving downwardly. This prevents the latch arm 234 from disengaging the bar 190, and secures the latch mechanism 140 in its fully latched condition until the CPA removed.

It is evident from FIGS. 7 and 8 that if the connector were not fully mated, and therefore the latched components 155 and 165 were not fully engaged, then the shoulder 192 of lateral latching bar 190 would not lock into place with edge 236 of latch arm 234. In this case, latching bar 190 would be in a downward flexed configuration, and would therefore engage the CPA at edge 104 to prevent the CPA from sliding into its final, or latched, position, thereby precluding complete installation of the CPA, and alerting the user that the connector was not properly mated. Conversely, it is evident from FIG. 8 that when the CPA is fully engaged, the shoulders 192 and 236 must be engaged, thereby assuring the user that, when the CPA is installed, the connector is fully mated and latched, and cannot inadvertently be demated. This can be readily confirmed by visual inspection and by manually checking that the CPA is locked in place. If the user wishes to demate the connector halves 150 and 160, the CPA can be manually slid back to its ready position, by applying sufficient force to cause the rounded edges of protrusion 100 and tabs 46 and 56 to slip out of their engaged positions with locking bar 193, thereby allowing the CPA to freely move along the direction of axis 12 (FIG. 1).

Although the present invention has been described in terms of a preferred embodiment, it will be apparent that variations and modifications may be make without departing from the true spirit and scope thereof, as set forth in the following claims.

What is claimed:

1. A molded plastic connector position assurance (CPA) component for use as a positive locking indicator for a releasable latching mechanism on electrical connectors, said CPA component comprising:

a body portion having first and second end walls, and a lower edge;

a first flexible side arm extending longitudinally forwardly from said first end wall of said body portion, and a second flexible side arm extending longitudinally forwardly from said second end wall of said body portion, each of said side arms further including an inwardly extending tab; and a flexible bent arm extending longitudinally from said lower edge of said body portion, said flexible bent arm including a first angled segment extending downwardly from said lower edge of said body portion, a second angled segment extending upwardly and away from said first angled segment, a third segment extending horizontally and substantially parallel to said first and second side arms, and a protrusion on a top surface of said flexible arm above a pivot point between said second and third segments.

2. In combination, an electrical connector, latch mechanism and a locking indicator, comprising:

a connector including first and second connector components;

a latch mechanism including a first part on said first connector component and a second part on said second connector component for securing said first and second connector components in a mated position, said first part of said latch mechanism including a first latch arm having a latching bar and a locking bar spaced from said latching bar, and said second part of said latching mechanism including a second latch arm having a projection for engaging said latching bar on said first part of said latching mechanism upon mating of said connector components;and a locking indicator comprising a molded plastic connector position assurance (CPA) component including a flexible arm having first and second angled segments joined at a pivot point, said second angled segment having a free end portion, said CPA component being slidably mounted on said first part of said latching mechanism, and having a rest position with said pivot point engaging a bottom surface of said locking bar and said free end portion engaging a slide of said latching bar prior to mating of said connector components, said first and second segments being pivoted about said pivot point upon mating of said connector components to move said fee end portion below said side of said latching bar upon engagement of said second latch arm with said latching bar to permit said CPA component to slide to an engaged position in which said free end portion slides beneath said latching bar to prevent said second latch arm from disengaging from said latching bar.

3. The connector, latch mechanism and locking indicator of claim 2, wherein said CPA component further includes a vertical protrusion on a top surface of said CPA at said pivot point for engaging said bottom surface of said locking bar in said rest position, and engaging a front side surface of said locking bar in said engaged position to lock said CPA component in said engaged position.

4. The connector, latch mechanism and locking indicator of claim 2, wherein said first segment of said flexible arm includes a bend for engaging an outer surfaces of a shell portion of said second connector component when said first and second connector components are secured in a mated position, to thereby cause said first and second segments to pivot about said pivot point and move said free end portion below said side of said latching bar.

* * * * *